US008791967B2

(12) United States Patent
Baba et al.

(10) Patent No.: US 8,791,967 B2
(45) Date of Patent: Jul. 29, 2014

(54) DISPLAY APPARATUS

(75) Inventors: Masahiro Baba, Yokohama (JP); Ryosuke Nonaka, Yokohama (JP); Yuma Sano, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 541 days.

(21) Appl. No.: 13/070,986

(22) Filed: Mar. 24, 2011

(65) Prior Publication Data

US 2012/0050352 A1 Mar. 1, 2012

(30) Foreign Application Priority Data

Aug. 24, 2010 (JP) ..... 2010-187542

(51) Int. Cl.
*G09G 5/10* (2006.01)

(52) U.S. Cl.
USPC ..... 345/690; 345/102; 345/691; 345/204; 345/589; 382/162; 382/170; 382/172; 358/518

(58) Field of Classification Search
USPC ..... 345/102, 690, 204, 589, 691; 382/162–172; 358/518
See application file for complete search history.

(56) References Cited

U.S. PATENT DOCUMENTS

| | | | | |
|---|---|---|---|---|
| 2009/0052774 | A1 * | 2/2009 | Yoshii et al. | 382/167 |
| 2010/0149224 | A1 | 6/2010 | Baba et al. | |
| 2010/0182346 | A1 | 7/2010 | Sano et al. | |
| 2010/0188443 | A1 * | 7/2010 | Lewis et al. | 345/691 |

FOREIGN PATENT DOCUMENTS

| | | | |
|---|---|---|---|
| JP | 2004-138827 | | 5/2004 |
| JP | 2005-258404 | | 9/2005 |
| JP | 2006-145982 | | 6/2006 |
| JP | 2007-59372 | | 3/2007 |
| JP | 2010-78982 | A | 4/2010 |
| JP | 2010-152174 | A | 7/2010 |
| WO | WO 2009/110129 | A1 | 9/2009 |

OTHER PUBLICATIONS

Japanese Office Action issued Jul. 31, 2012 in Patent Application No. 2010-187542 with English Translation.

* cited by examiner

*Primary Examiner* — Shaheda Abdin
(74) *Attorney, Agent, or Firm* — Oblon, Spivak, McClelland, Maier & Neustadt, L.L.P.

(57) ABSTRACT

According to one embodiment, a display apparatus includes a light modulating unit, a light source unit, a luminance setting unit, a luminance distribution calculating unit, a signal level converting unit, and a control unit. The light source unit includes a basic light source and an extended light source illuminating each of divisional areas into which the display area tentatively divided. The basic light source emits white light with first emission peak wavelengths. The extended light source emits light with a second emission peak wavelength being different from the first emission peak wavelengths and being within a range between shortest and longest wavelengths of the first emission peak wavelengths. The control unit is configured to generate a control signal controlling the basic light source and the extended light source so as to provide a period in which the basic light source and the extended light source simultaneously emit light.

4 Claims, 6 Drawing Sheets

DISPLAY APPARATUS

CROSS-REFERENCE TO RELATED APPLICATIONS

This application is based upon and claims the benefit of priority from Japanese Patent Application No. 2010-187542, filed Aug. 24, 2010; the entire contents of which are incorporated herein by reference.

FIELD

Embodiments described herein relate generally to a display apparatus such as a liquid crystal display apparatus.

BACKGROUND

Recently, a display apparatus including a light source and a light modulating element that modulates the intensity of light incident from the light source is widely used as is represented by a liquid crystal display apparatus. In such a display apparatus, since the light modulating element does not have an ideal modulation characteristic, there occurs a problem that the contrast is degraded because of light leakage from the light modulating element particularly when black is displayed and the displayable color gamut is narrow.

In order to solve the above problem, JP-A 2006-145982 (KOKAI) discloses a liquid crystal display apparatus including a color filter of four or more primary colors. Further, JP-A 2004-138827 (KOKAI) discloses a liquid crystal display apparatus that switches emission colors of a light source unit based on a time-division system to perform time-division display. In addition, JP-A 2007-59372 (KOKAI) discloses a liquid crystal display apparatus in which a red light source of a wavelength longer than a normal red wavelength is added to a light source unit to extend the color gamut. Further, JP-A 2005-258404 (KOKAI) discloses a method for performing both of modulation of the luminance of light sources corresponding to the three primary colors in light according to an input image and conversion of signal levels of respective pixels of the input image.

In each of the above techniques, the reproducible color gamut can be extended. However, in JP-A 2006-145982 (KOKAI), since pixels having a color different from the three primary colors are additionally provided in a liquid crystal panel, the number of pixels of the panel is increased and the manufacturing cost of the liquid crystal panel and the cost of the drive circuit are increased. Further, the effect of an increase in the color gamut by the color filter of the panel is small. In JP-A 2004-138827 (KOKAI), since time-division display is performed, the luminance is lowered, color breakup occurs and the image quality is degraded. In JP-A 2007-59372 (KOKAI), the color gamut can be extended only on the long wavelength (red) side or short wavelength (blue) side. In JP-A 2005-258404 (KOKAI), the effect of color gamut extension is large, but it is necessary to further extend the color gamut since the range of colors present in nature is wide.

Therefore in the display apparatus, it is required to extend the reproducible color gamut.

DETAILED DESCRIPTION

In general, according to one embodiment, a display apparatus includes a light modulating unit, a light source unit, a luminance setting unit, a luminance distribution calculating unit, a signal level converting unit, and a control unit. The light modulating unit is configured to modulate light in accordance with a drive signal, and display an image in a display area. The light source unit includes a basic light source and an extended light source illuminating each of divisional areas into which the display area tentatively divided. The basic light source emits white light with first emission peak wavelengths. The extended light source emits light with a second emission peak wavelength. The second emission peak wavelength is different from the first emission peak wavelengths and within a range between shortest and longest wavelengths of the first emission peak wavelengths. The luminance setting unit is configured to calculate, for each of the divisional areas, luminance values of the basic light source and the extended light source based on a signal level of an input image signal. The luminance distribution calculating unit is configured to calculate a luminance distribution if the basic light source and the extended light source emit light in accordance with a luminance signal. The signal level converting unit is configured to convert the signal level based on a luminance distribution signal. The control unit is configured to generate the drive signal based on a converted image signal and generate a control signal controlling the basic light source and the extended light source based on the luminance signal so as to provide a period in which the basic light source and the extended light source simultaneously emit light.

Hereinafter, display apparatuses according to various embodiments are described with reference to the accompanying drawings. In the embodiments, like reference numbers denote like elements, and duplication of explanation will be avoided.

First Embodiment

Figure 1:
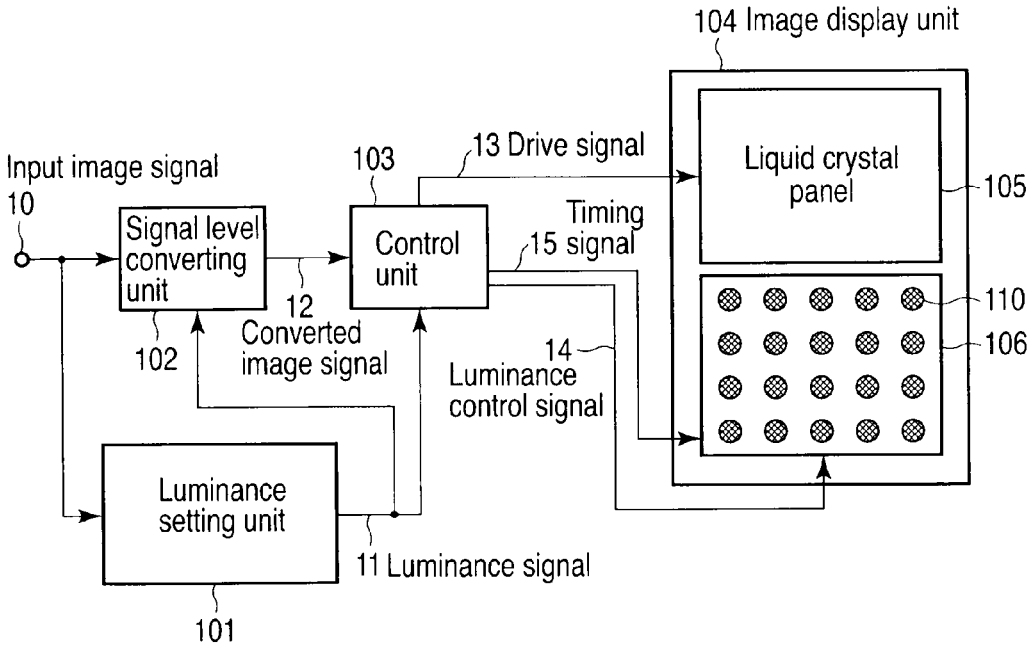
FIG. 1 is a block diagram schematically showing a display apparatus according to a first embodiment.

FIG. 1 schematically shows a display apparatus according to a first embodiment. The display apparatus includes a luminance-setting unit 101, signal level converting unit 102, control unit 103 and image display unit 104. In this embodiment, the image display unit 104 is a liquid crystal display module that includes a backlight 106 corresponding to a light source unit and a liquid crystal panel 105 corresponding to a light modulating unit. The backlight 106 includes a plurality of multi-color light sources 110 and is arranged in opposition to the back surface of the liquid crystal panel 105. In one example, the multi-color light sources 110 are arranged in rows and columns on the backlight 106.

In the display apparatus of FIG. 1, an input image signal 10 is input to the luminance-setting unit 101 and signal level converting unit 102. The input image signal 10 is a moving image or still image and input in the frame unit, for example. The luminance-setting unit 101 calculates light source luminance (emission intensity) of the multi-color light sources 110 for displaying an image depending on the input image signal 10 on the image display unit 104 to generate a light source luminance signal (also referred to simply as a luminance signal) 11. As will be described later, each of the multi-color light sources 110 includes plural types of light sources having different emission peak wavelengths. The light source luminance of the multi-color light source 110 indicates respective luminance values of the light sources included in the multi-color light source 110. The luminance signal 11 is transmitted to the signal level converting unit 102 and control unit 102.

The signal level converting unit 102 converts the signal levels of respective pixels of the input image signal 10 based on the luminance signal 11 to generate a converted image signal 12. In this embodiment, each pixel of the input image signal 10 has signal levels of three primary colors, that is, red, green and blue and the signal level converting unit 102 converts the signal level of each color for each pixel.

The control unit 103 controls the image display unit 104 according to the converted image signal 12 and luminance signal 11. The control unit 103 generates a drive signal 13, which is used to drive the liquid crystal panel 105, based on the converted image signal 12 and transmits the drive signal 13 to the liquid crystal panel 105. In addition, the control unit 103 transmits the luminance signal 11 as a light source luminance control signal (also referred to simply as a control signal) 14 to the backlight 106. Further, the control unit 103 transmits a timing signal 15 that specifies timing at which the multi-color light sources 110 emit light to the backlight 106. The timing signal 15 may be contained in the control signal 14.

In the image display unit 104, the liquid crystal panel 105 is driven according to the drive signal 13, that is, a converted image depending on the converted image signal 12 is displayed on the liquid crystal panel 105. Further, in the image display unit 104, the multi-color light sources 110 emit light with luminance corresponding to the control signal 14 at timing corresponding to the timing signal 15. Therefore, the image depending on the input image signal 10 is displayed on the image display unit 104.

Figure 2:
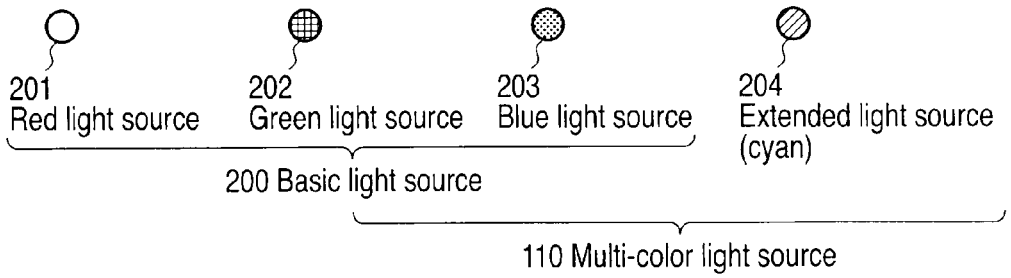
FIG. 2 is a schematic diagram showing a multi-color light source shown in FIG. 1.

FIG. 2 shows one example of the multi-color light source 110. The multi-color light source 110 includes a basic light source 200 and an extended light source 204. The basic light source 200 has a plurality of emission peak wavelengths and can emit light in white. The extended light source 204 has an emission peak wavelength between the shortest and longest emission peak wavelengths of the emission peak wavelengths of the basic light source 200. The emission peak wavelength of the extended light source 204 is different from the emission peak wavelengths of the basic light source 200.

As one example, the basic light source 200 includes a red light source 201, green light source 202 and blue light source 203 having emission peak wavelengths corresponding to red, green and blue, which are the three primary colors in light, respectively. The extended light source 204 has an emission peak wavelength between the emission peak wavelength of blue which is the shortest wavelength among the emission peak wavelengths of the basic light source 200 and the emission peak wavelength of red which is the longest wavelength among the emission peak wavelengths of the basic light source 200. In the present embodiment, the extended light source 204 is a cyan light source having an emission peak wavelength corresponding to cyan between the emission peak wavelengths of the green light source 202 and the blue light source 203.

The basic light source 200 is not limited to the example in which the red light source 201, green light source 202 and blue light source 203 as shown in FIG. 2 are provided, and the basic light source 200 may be a white light source having emission peak wavelengths of red, green and blue or a white light source having emission peak wavelengths of blue and yellow. Alternatively, the basic light source 200 may include a blue light source having an emission peak wavelength of blue and a yellow light source having an emission peak wavelength of yellow so as to emit light in white.

Further, the extended light source 204 is not limited to the cyan light source and may be a yellow light source having an emission peak wavelength of yellow between the emission peak wavelengths of the green light source 202 and red light source 201. Further, the extended light source 204 may have a plurality of emission peak wavelengths or include a plurality of light sources having different emission peak wavelengths. For example, the extended light source 204 can include a cyan light source having an emission peak wavelength of cyan and a yellow light source having an emission peak wavelength of yellow.

Next, the respective units in the display apparatus of FIG. 1 are explained in more detail.

Figure 3:
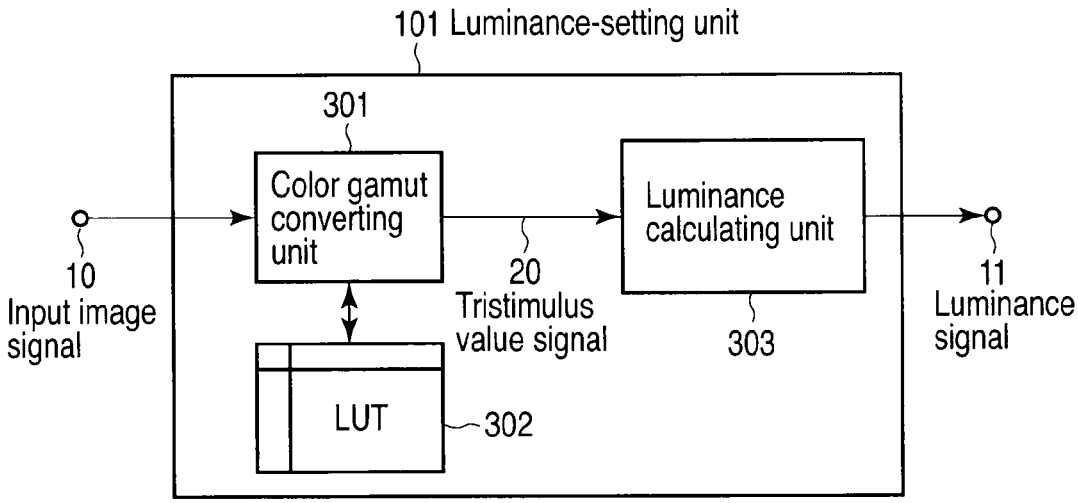
FIG. 3 is a block diagram schematically showing a luminance-setting unit shown in FIG. 1.

The luminance-setting unit 101 calculates the light source luminance of the multi-color light source 110, i.e., respective luminance values of the red light source 201, green light source 202, blue light source 203 and extended light source 204 based on the input image signal 10. Specifically, as shown in FIG. 3, the luminance-setting unit 101 includes a color gamut converting unit 301, look-up table (LUT) 302 and luminance calculating unit 303.

The color gamut converting unit 301 converts signal levels of respective colors for each pixel of the input image signal 10 from the color gamut of the input image signal 10 to a preset color gamut. The preset color gamut is contained in the color gamut displayable on the image display unit 104. As an example, the preset color gamut can be set to the maximum color gamut that can be displayed on the image display unit 104 and obtained by controlling the basic light source 200 and extended light source 204.

The color gamut converting unit 301 first performs inverse gamma correction of signal levels $L_R(x, y)$, $L_G(x, y)$, $L_B(x, y)$ in the pixel position (x, y) of the input image signal 10 according to Equation (1).

$$R_{in}(x, y) = g\left(\frac{L_R(x, y)}{255}\right) \quad (1)$$

$$G_{in}(x, y) = g\left(\frac{L_G(x, y)}{255}\right)$$

$$B_{in}(x, y) = g\left(\frac{L_B(x, y)}{255}\right)$$

Where

-continued $$g(L)=\begin{cases}\dfrac{L}{4.5} & 0\le L<0.081\\ \left(\dfrac{L+0.099}{1.099}\right)^{\frac{1}{0.45}} & 0.081\le L<1.\end{cases}$$

In Equation (1), $R_{in}(x, y)$, $G_{in}(x, y)$, $B_{in}(x, y)$ indicate values obtained after inverse gamma correction of signal levels $L_R(x, y)$, $L_G(x, y)$, $L_B(x, y)$ corresponding to red, green and blue. In this embodiment, the signal level of the input image signal 10 is expressed by 8 bits, that is, expressed by an integral number from 0 to 255 and values $R_{in}(x, y)$, $G_{in}(x, y)$, $B_{in}(x, y)$ obtained after inverse gamma correction become relative values of 0 to 1. The inverse gamma correction is performed according to an equation defined by the signal standard of the input image signal 10. In this embodiment, the inverse gamma correction is performed according to Equation (1) on the assumption that the signal standard of the input image signal 10 corresponds to ITU-R BT. 709.

An example in which values obtained after the inverse gamma correction are calculated according to Equation (1) is explained above, but this is not limited to this example. As one example, the LUT 302 in which the relationship between the signal levels and values obtained after the inverse gamma correction is listed may be previously stored in a recording medium such as a ROM (Read Only Memory) and the color gamut converting unit 301 may derive values $R_{in}(x, y)$, $G_{in}(x, y)$, $B_{in}(x, y)$ after the inverse gamma correction with reference to the LUT 302 by use of the signal levels $L_R(x, y)$, $L_G(x, y)$, $L_B(x, y)$ of the input image signal 10.

Next, the color gamut converting unit 301 calculates tristimulus values $X_{in}(x, y)$, $Y_{in}(x, y)$, $Z_{in}(x, y)$ of an XYZ display color series based on values $R_{in}(x, y)$, $G_{in}(x, y)$, $B_{in}(x, y)$ obtained after the inverse gamma correction according to Equation (2).

$$\begin{bmatrix}X_{in}(x, y)\\ Y_{in}(x, y)\\ Z_{in}(x, y)\end{bmatrix}=M\begin{bmatrix}R_{in}(x, y)\\ G_{in}(x, y)\\ B_{in}(x, y)\end{bmatrix} \tag{2}$$

where M indicates a 3×3 matrix and is defined according to the signal standard of the input image signal 10. In this embodiment, the signal standard of the input image signal 10 is ITU-R BT. 709 and matrix M is a matrix that converts values $R_{in}(x, y)$, $G_{in}(x, y)$, $B_{in}(x, y)$ obtained after inverse gamma correction of ITU-R BT. 709 to tristimulus values $X_{in}(x, y)$, $Y_{in}(x, y)$, $Z_{in}(x, y)$.

Figure 4:
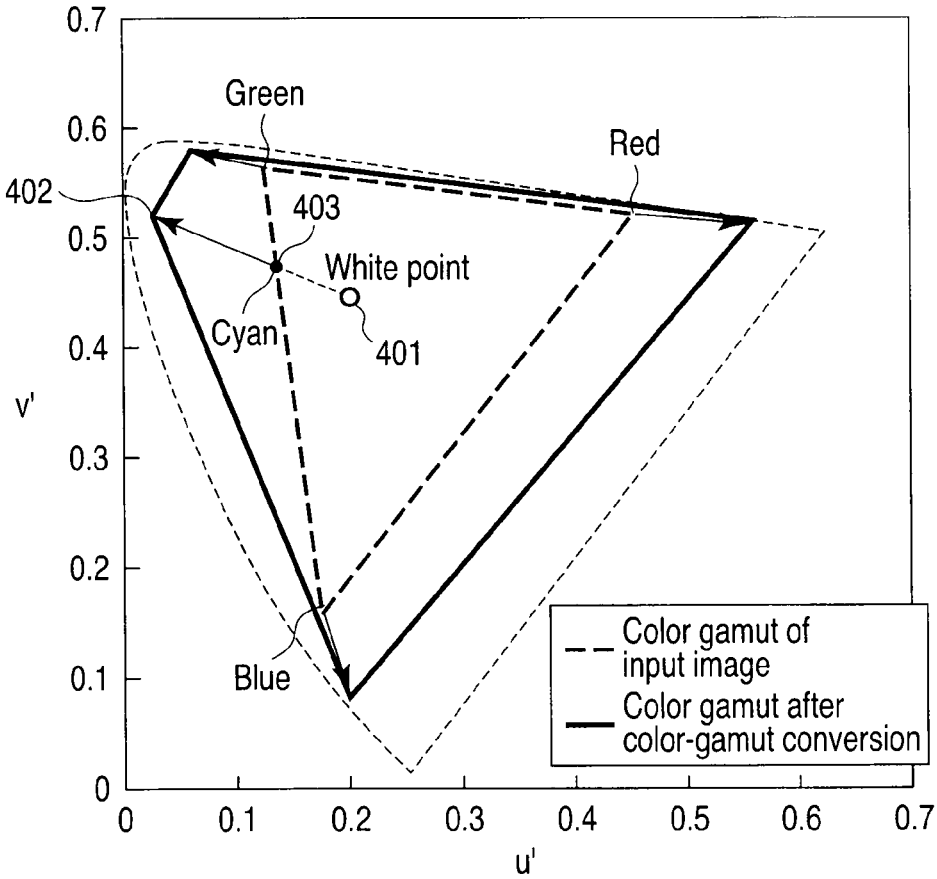
FIG. 4 is a graph showing the maximum color gamut that can be displayed on the image display unit of FIG. 1.

Next, the color gamut converting unit 301 performs color gamut conversion of calculated tristimulus values $X_{in}(x, y)$, $Y_{in}(x, y)$, $Z_{in}(x, y)$ to derive tristimulus values $X_t(x, y)$, $Y_t(x, y)$, $Z_t(x, y)$ subjected to the color gamut conversion. One example of color gamut conversion is shown in FIG. 4. FIG. 4 is a u'-v' chromaticity diagram and shows variation in the color gamut by color gamut conversion. In FIG. 4, broken lines indicate a color gamut of the input image signal 10 of ITU-R BT. 709 and solid lines indicate the maximum color gamut displayable on the image display unit 104 when the luminance values of the red light source 201, green light source 202, blue light source 203 and cyan light source 204 in the multi-color light sources 110 are controlled. In the color gamut conversion, the chromaticity of red, green and blue of the input image signal 10 is extended to the chromaticity of red, green and blue in the maximum color gamut of the image display unit 104. In regard to the extended light source 204, a point 403 at which a straight line connecting a white point 401 of the input image signal 10 to chromaticity 402 of cyan in the maximum color gamut of the image display unit 104 intersects with a straight line connecting the chromaticity of green of the input image signal 10 to the chromaticity of blue of the input image signal 10 is extended to the chromaticity 402 of cyan in the maximum color gamut of the image display unit 104. Colors in the color gamut determined by three primary colors of the input image signal 10 are color-converted to continuously change the chromaticity.

Thus, since the backlight 106 includes the extended light source 204 in addition to the basic light source 200 that can emit light in white and the color gamut displayable on the image display unit 104 is extended, the reproducible color gamut of the display image can be increased.

In this embodiment, the relationship between the tristimulus values calculated based on the input image signal 10 and the tristimulus values obtained after color gamut conversion is previously derived and the LUT 302 having the above relationship listed therein is stored in the recording medium. The color gamut converting unit 301 refers to the LUT 302 by use of tristimulus values $X_{in}(x, y)$, $Y_{in}(x, y)$, $Z_{in}(x, y)$ calculated based on the input image signal 10 to derive tristimulus values $X_t(x, y)$, $Y_t(x, y)$, $Z_t(x, y)$, for each pixel. A tristimulus value signal 20 including tristimulus values $X_t(x, y)$, $Y_t(x, y)$, $Z_t(x, y)$ obtained after color gamut conversion is transmitted to the luminance calculating unit 303.

The luminance calculating unit 303 calculates respective luminance values of the red light source 201, green light source 202, blue light source 203 and extended light source 204 based on tristimulus values $X_t(x, y)$, $Y_t(x, y)$, $Z_t(x, y)$ obtained after color gamut conversion. The luminance calculating unit 303 first detects the maximum tristimulus values $X_{max}(x, y)$, $Y_{max}(x, y)$, $Z_{max}(x, y)$ of tristimulus values $X_t(x, y)$, $Y_t(x, y)$, $Z_t(x, y)$ obtained after color gamut conversion, respectively. That is, the luminance calculating unit 303 detects the maximum tristimulus values $X_{max}(x, y)$, $Y_{max}(x, y)$, $Z_{max}(x, y)$ in the input image signal 10 of one frame.

Next, the luminance calculating unit 303 calculates luminance value for displaying the maximum tristimulus value, for each of the red light source 201, green light source 202, blue light source 203 and extended light source 204. However, since four luminance values are derived based on three tristimulus values, the solution is not limited to only one. In this embodiment, a combination of luminance values $R_{BL}$, $G_{BL}$, $B_{BL}$, $C_{BL}$ of red, green, blue and cyan, which are calculated as relative values of 0 to 1, is derived so as to set minimum the power consumptions of the red light source 201, green light source 202, blue light source 203 and extended light source 204. That is, luminance values $R_{BL}$, $G_{BL}$, $B_{BL}$, $C_{BL}$ are calculated by solving Equation (4) under the constraint condition of Equation (3). Thus, the power consumption in the image display unit 104 can be reduced by determining luminance values with which light source are to emit light while imposing the condition that the power consumption of the light source 110 becomes minimum.

$$\begin{bmatrix}X_R & X_G & X_B & X_C\\ Y_R & Y_G & Y_B & Y_C\\ Z_R & Z_G & Z_B & Z_C\end{bmatrix}\begin{bmatrix}R_i\\ G_i\\ B_i\\ C_i\end{bmatrix}=\begin{bmatrix}X_{max}\\ Y_{max}\\ Z_{max}\end{bmatrix} \tag{3}$$

$$0\le R_i<1,\ 0\le G_i<1,\ 0\le B_i<1,\ 0\le C_i<1$$

-continued $$R_{BL}, G_{BL}, B_{BL}, C_{BL} = \arg\min_{R_t,G_t,B_t,C_t} (p_R R_i + p_G G_i + p_B B_i + p_C C_i) \quad (4)$$

where $(X_R, Y_R, Z_R)$, $(X_G, Y_G, Z_G)$, $(X_B, Y_B, Z_B)$, $(X_C, Y_C, Z_C)$ respectively indicate tristimulus values when the red light source 201, green light source 202, blue light source 203 and extended light source 204 emit light while white is displayed on the liquid crystal panel 105. Further, $p_R$, $p_G$, $p_B$, $p_C$ respectively indicate power consumption ratios of the red light source 201, green light source 202, blue light source 203 and extended light source 204. The power consumption ratio is set larger as the power consumption is larger. Equations (3) and (4) are minimization problems with the constraint condition and can be solved by use of a linear programming method, for example.

In this embodiment, luminance values are derived under the condition that the power consumption is minimized as shown in Equation (4), but the condition is not limited to this case and luminance values may be derived under another condition. Further, the luminance calculating unit 303 may not only derive luminance values by performing numeric calculations according to Equations (3) and (4) but also derive luminance values by use of another method. As one example, power consumptions and the color gamut of the image display unit 104 when a combination of luminance values $R_{BL}$, $G_{BL}$, $B_{BL}$, $C_{BL}$ is variously changed are measured and a combination of luminance values $R_{BL}$, $G_{BL}$, $B_{BL}$, $C_{BL}$ that makes the power consumption small and makes the color gamut of the image display unit 104 large is derived by adjustment. A look-up table in which the relationship between the maximum tristimulus values and luminance values of the respective colors is listed is previously prepared and the luminance calculating unit 303 may refer to the look-up table with the acquired maximum tristimulus values to derive luminance values $R_{BL}$, $G_{BL}$, $B_{BL}$, $C_{BL}$ of the respective colors.

Thus, in this embodiment, the contrast and reproducible color gamut of a display image can be enhanced by controlling the luminance of the multi-color light sources 110 in the backlight 106 according to the input image signal 10.

The signal level converting unit 102 converts signal levels of respective pixels of the input image signal 10 based on light source luminance derived by the luminance-setting unit 101, that is, luminance values $R_{BL}$, $G_{BL}$, $B_{BL}$, $C_{BL}$ of red, green, blue and cyan to derive a converted image signal 12.

The signal level converting unit 102 first derives tristimulus values $X_t(x, y)$, $Y_t(x, y)$, $Z_t(x, y)$ after color gamut conversion based on signal levels $L_R(x, y)$, $L_G(x, y)$, $L_B(x, y)$ of the input image signal 10 like the color gamut converting unit 301 of the luminance-setting unit 101.

Then, the signal level converting unit 102 converts tristimulus values $X_t(x, y)$, $Y_t(x, y)$, $Z_t(x, y)$ obtained after color gamut conversion to converted signal levels $L_R'(x, y)$, $L_G'(x, y)$, $L_B'(x, y)$ in order to display tristimulus values $X_t(x, y)$, $Y_t(x, y)$, $Z_t(x, y)$ obtained after color gamut conversion on the image display unit 104 when the multi-color light sources 110 emits light according to luminance values $R_{BL}$, $G_{BL}$, $B_{BL}$, $C_{BL}$. The conversion method can be variously considered. In this embodiment, converted signal levels are manually adjusted to display tristimulus values $X_t(x, y)$, $Y_t(x, y)$, $Z_t(x, y)$ obtained after color gamut conversion on the image display unit 104 when the multi-color light sources 110 emit light according to luminance values $R_{BL}$, $G_{BL}$, $B_{BL}$, $C_{BL}$. In this case, the relationship among the luminance values, tristimulus values obtained after color gamut conversion and converted signal levels is previously derived and the signal level converting unit 102 has an LUT (not shown) in which the relationship is listed. The signal level converting unit 102 derives converted signal levels with reference to the LUT according to the luminance values and tristimulus values obtained after color gamut conversion.

Thus, the signal level converting unit 102 derives converted signal levels $L_R'(x, y)$, $L_G'(x, y)$, $L_B'(x, y)$ for respective pixels of the input image signal 10 to generate a converted image signal 12. The converted image signal 12 includes converted signal levels $L_R'(x, y)$, $L_G'(x, y)$, $L_B'(x, y)$ of all of the pixels. The converted image signal 12 is transmitted to the control unit 103.

The control unit 103 generates a drive signal 13 including the converted image signal 12 and a synchronizing signal that specifies timing at which the converted image signal 12 is applied to the liquid crystal panel 105. As one example, the synchronizing signal includes horizontal and vertical synchronizing signals to drive the liquid crystal panel 105. Further, the control unit 103 generates control signals 14 that cause the red light source 201, green light source 202, blue light source 203 and extended light source 204 to actually emit light according to the luminance signal 11. Further, the control unit 103 generates a timing signal 15 that specifies timing at which the light sources 201, 202, 203, 204 emit light. The drive signal 13 is transmitted to the liquid crystal panel 105 and the control signals 14 and timing signal 15 are transmitted to the backlight 106.

Figure 5:
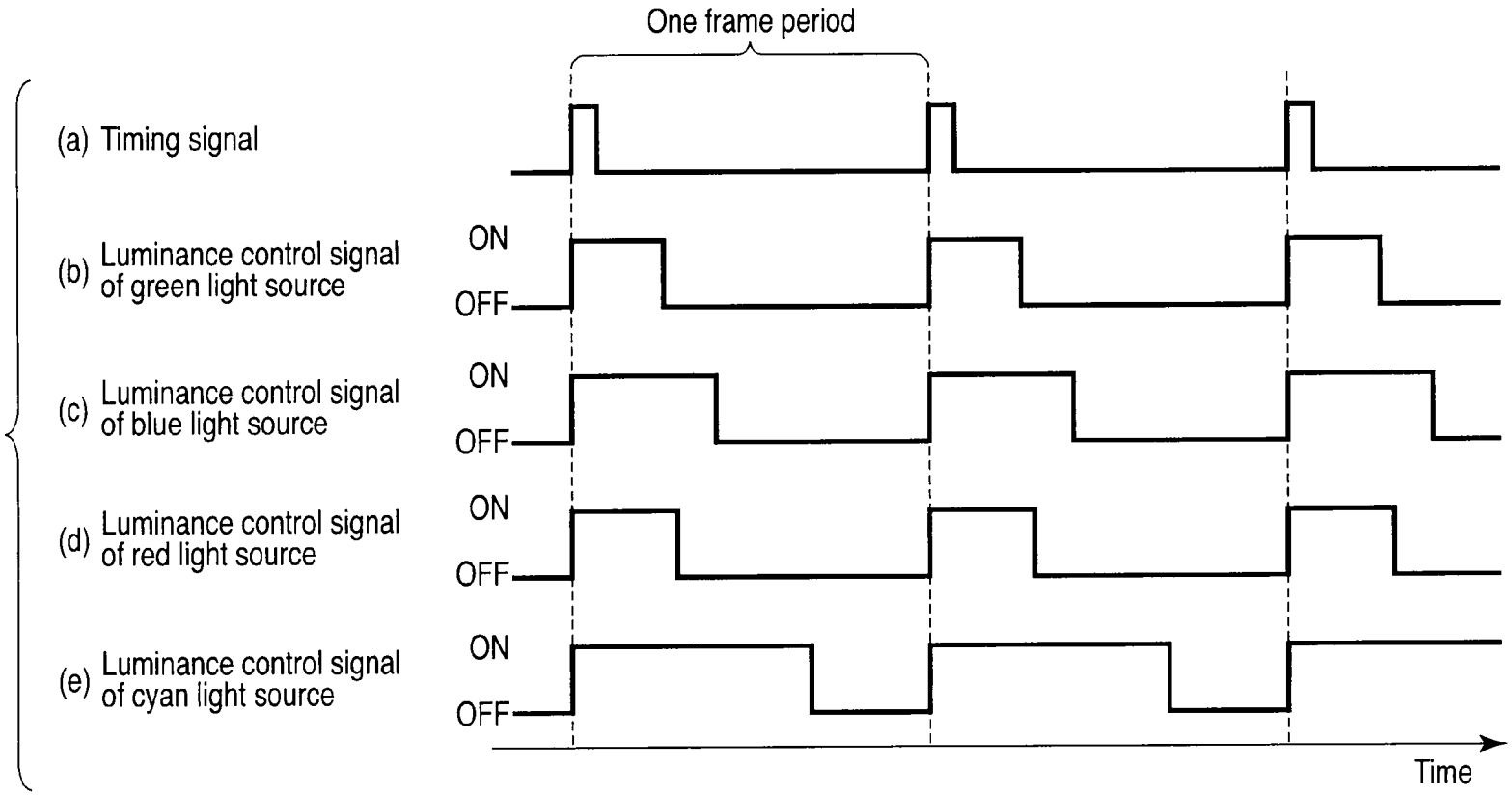
FIG. 5 is a timing chart showing an example of the relationship between a timing signal and luminance control signals of respective light sources shown in FIG. 2.

FIG. 5 shows the relationship of timings of the timing signal and the control signals of red, green, blue and cyan. In this embodiment, the light sources 201, 202, 203, 204 in the multi-color light sources 110 are light-emitting diodes (LED) and the luminance modulation operation of each light source 201, 202, 203, 204 is performed by pulse-width modulation (PWM). In the pulse-width modulation control operation, the luminance of each light source is modulated by rapidly switching the ratio of the light-emission period (indicated by ON in FIG. 5) to the non-emission period (indicated by OFF in FIG. 5).

As shown in FIG. 5(*a*), the timing signal 15 is a signal that specifies timing at which the multi-color light sources 110 emit light once in one frame period. As shown in FIG. 5(*b*) to (*e*), the control signals of the respective colors are PWM signals having pulse widths of the lengths corresponding to the luminance values of the respective colors and drive the respective light sources 201, 202, 203, 204 at timing synchronized with the timing signal 15. Therefore, the red light source 201, green light source 202, blue light source 203 and extended light source 204 simultaneously start to emit light, i.e., have periods in which light is simultaneously emitted. In this embodiment, since the respective light sources 201, 202, 203, 204 are driven to have periods in which light is simultaneously emitted, sufficient luminance can be obtained, color breakup does not occur and the image quality can be enhanced.

In FIG. 5, an example in which the red light source 201, green light source 202, blue light source 203 and extended light source 204 have periods in which light is simultaneously emitted is shown, but this is not limitative. For example, it is sufficient if at least two of the red light source 201, green light source 202, blue light source 203 and extended light source 204 have periods in which light is simultaneously emitted. For example, the extended light source 204 may be driven to start light emission at timing different from that of the red light source 201, green light source 202 and blue light source 203.

As described above, the image display unit 104 includes the backlight 106 and the liquid crystal panel 105 that modulates the transmittance for light incident from the backlight 106. Generally, as a light source for the backlight 106, a light source such as a cold cathode tube, light-emitting diode (LED) or the like is used. In this embodiment, an LED light source whose luminance can be easily controlled is used as the light source of the backlight 106 and the luminance of the LED light source is modulated by the PWM control operation. The control signal 14 is a PWM signal generated based on the luminance signal 11.

In the image display unit 104, the liquid crystal panel 105 is driven by a drive signal generated by the control unit 103, that is, the converted image signal 12 generated by the signal level converting unit 102 is applied to the liquid crystal panel 105. Further, in the image display unit 104, the multi-color light sources 110 of the backlight 106 emit light at timing determined by the timing signals 15 with luminance according to the control signal 14 generated by the control unit 103. As a result, an image depending on the input image signal 10 is displayed on the image display unit 104.

As described above, the display apparatus according to the first embodiment includes the extended light source 204 having an emission peak wavelength between the emission peak wavelength of the red light source 201 and the emission peak wavelength of the blue light source 203 in addition to the basic light source 200 including the red light source 201, green light source 202 and blue light source 203 corresponding to the primary colors. This display apparatus modulates the luminance of the red light source 201, green light source 202, blue light source 203 and extended light source 204 according to the input image signal 10 and converts the signal levels of the input image signal 10 to enhance the contrast and reproducible color gamut of the display image.

Second Embodiment

Figure 6:
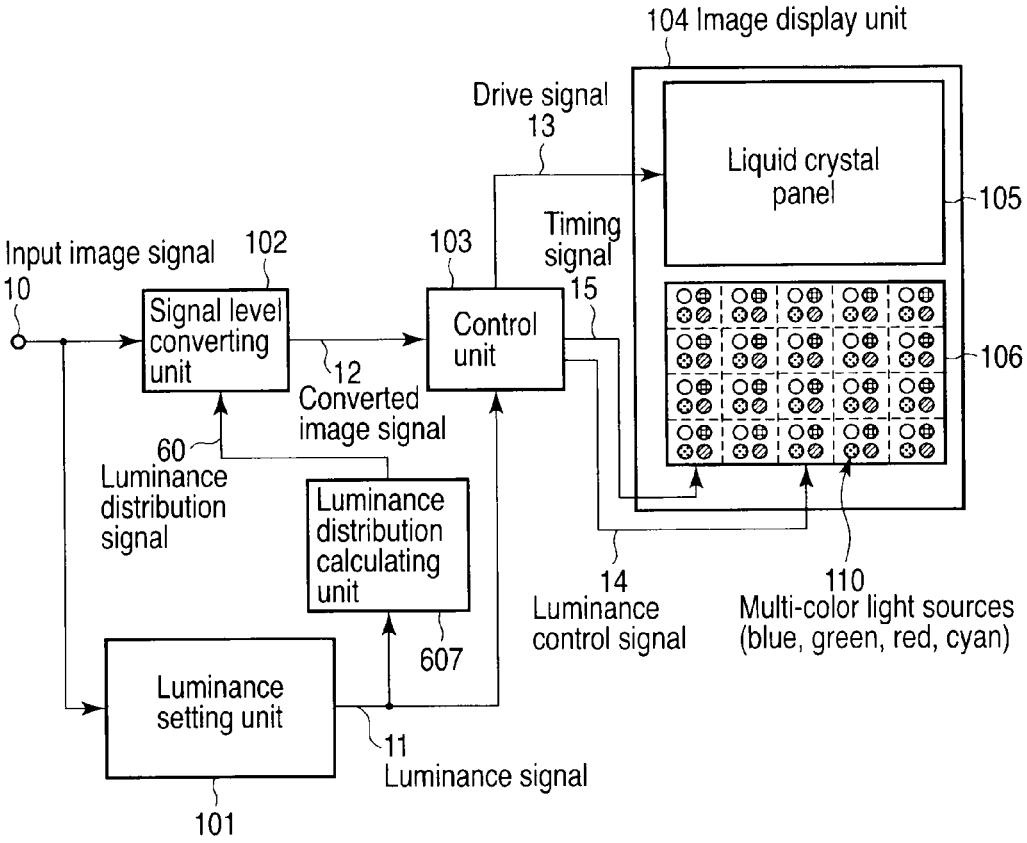
FIG. 6 is a block diagram schematically showing a display apparatus according to a second embodiment.

FIG. 6 schematically shows a display apparatus according to a second embodiment. Unlike the first embodiment, the display apparatus according to the second embodiment controls an image display unit 104 for respective divisional areas set in a backlight 106.

The display apparatus of FIG. 6 includes a luminance-setting unit 101, luminance distribution calculating unit 607, signal level converting unit 102, control unit 103 and image display unit 104. The luminance-setting unit 101, signal level converting unit 102 and control unit 103 in this embodiment perform operations that are partially different from the operations explained in the first embodiment to control the multi-color light source 110 for each divisional area. In regard to the luminance-setting unit 101, signal level converting unit 102 and control unit 103, the operations different from those of the first embodiment are mainly explained.

Figure 7:
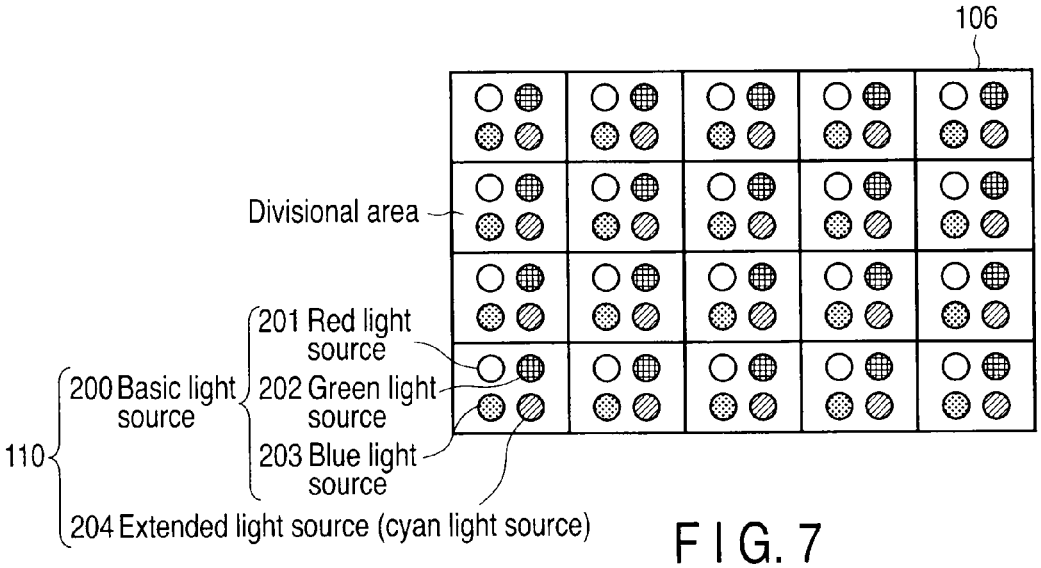
FIG. 7 is a schematic diagram showing divisional areas set on a backlight shown in FIG. 6.

FIG. 7 shows one example of divisional areas set on the backlight 106. In FIG. 7, the multi-color light sources 110 are arranged in rows and columns and one multi-color light source 110 is contained in each of the divisional areas obtained by tentatively dividing the backlight 106. More specifically, five multi-color light sources 110 are arranged in each row and four multi-color light sources 110 are arranged in each column. Thus, the backlight 106 is divided into 5×4 rectangular divisional areas and each divisional area includes one multi-color light source 110. Each of the multi-color light sources 110 includes a basic light source 200 and extended light source 204. The basic light source 200 includes a set of red, green and blue light sources 201, 202 and 203. The red light source 201 emits light rays with emission peak wavelengths of red. The green light source 202 emits light rays with emission peak wavelengths of green. The blue light source 203 emits light rays with emission peak wavelengths of blue. The extended light source 204 emits light rays with an emission peak wavelength of cyan. The emission peak wavelength of the extended light source 204 is a wavelength between the emission peak wavelengths of the green light source 202 and blue light source 203.

The number of multi-color light sources 110 included in each divisional area is not limited to one and the backlight 106 may be divided into areas to provide a plurality of multi-color light sources 110 in each divisional area.

Next, the respective portions of the display apparatus of FIG. 6 are explained in more detail.

In the display apparatus of FIG. 6, an input image signal 10 is input to the luminance-setting unit 101 and signal level converting unit 102. The luminance-setting unit 101 tentatively divides an input image depending on the input image signal 10 into a plurality of (for example, 5×4) divisional areas corresponding to the divisional areas set on the backlight 106. The luminance-setting unit 101 calculates light source luminance of the multi-color light sources 110 for each of the divisional areas. The input image signal 10 includes pixels of a number larger than the number of multi-color light sources 110, and therefore, a plurality of pixels are included in each of the divisional areas into which the input image is tentatively divided.

The operation of the luminance-setting unit 101 of the present embodiment is explained in more detail. First, the luminance-setting unit 101 converts the signal levels of the input image signal 10 for each pixel from the color gamut of the input image signal 10 to the color gamut displayable on the image display unit 104. Specifically, the luminance-setting unit 101 calculates, for each pixel, values obtained after inverse gamma correction based on the signal levels of the input image signal 10 according to Equation (1), for example, and calculates, for each pixel, tristimulus values based on the values obtained after inverse gamma correction according to Equation (2), for example.

Next, the luminance-setting unit 101 calculates a light source luminance of each multi-color light source 110 based on the calculated tristimulus values for each divisional area. The light source luminance of each multi-color light source 110 indicates luminance values of the right sources 201, 202 and 203 included in the multi-color light source 110. Specifically, the luminance-setting unit 101 detects the maximum tristimulus values based on the calculated tristimulus values for each divisional area and calculates, for each divisional area, light source luminance of the multi-color light sources 110 based on the maximum tristimulus values under the condition that the power consumption of the multi-color light sources 110 is minimized according to Equations (3) and (4), for example, to generate a luminance signal 11. Therefore, in the luminance signal 11 of this embodiment, light source luminances of the multi-color light sources 110 of respective divisional areas are contained. The luminance signal 11 is transmitted to the luminance distribution calculating unit 607 and control unit 103.

As the method for dividing the input image into a plurality of divisional areas, the method is not limited to an example of uniformly dividing the areas as shown in FIG. 7 and a method for setting divisional areas to partly overlap in the input image may be used.

The luminance distribution calculating unit 607 calculates, for each of light sources 201, 202, 203, and 204, the entire luminance distribution of the backlight 106 (also referred to as backlight luminance distribution) when all of the multi-color light sources 110 simultaneously emit light according to the luminance values calculated for respective divisional areas (or the luminance signal 11). The backlight luminance distribution for each of light sources 201, 202, 203, and 204 is obtained by adding individual luminance distributions when the corresponding light sources of the respective multi-color light sources 110 independently emit light.

Figure 8:
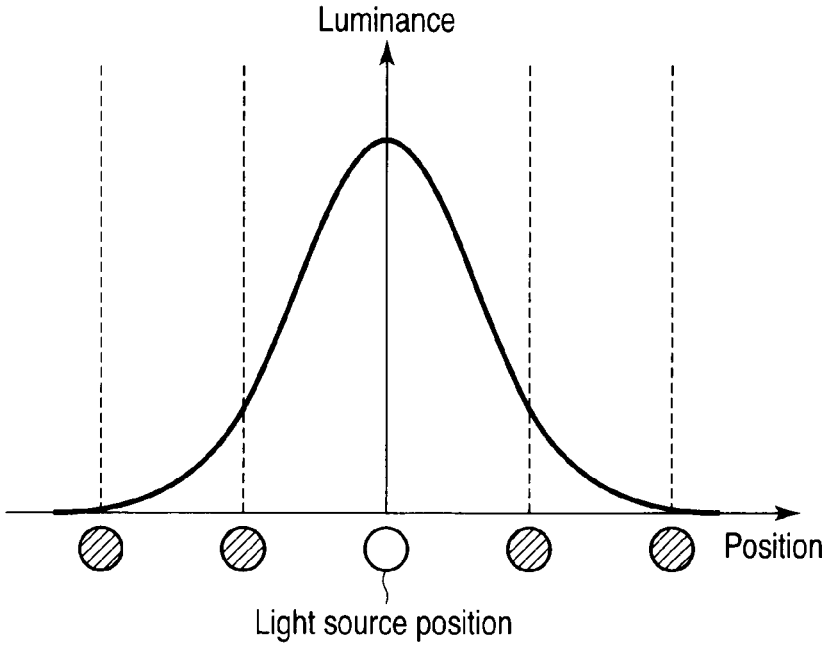
FIG. 8 is a graph schematically showing luminance distribution when one of light sources in the backlight shown in FIG. 6 emits light.

FIG. 8 schematically shows individual luminance distribution (emission luminance distribution) when one of the light sources of the backlight 106 (for example, one of the red light source 201, green light source 202, blue light source 203 and extended light source 204) emits light. For simplifying the explanation, FIG. 8 shows one-dimensional luminance distribution, the transverse axis indicates the position and the vertical axis indicates luminance. In FIG. 8, light sources are set in positions indicated by circles below the transverse axis and emission luminance distribution when the light source indicated by the white circle of the circles independently emits light is shown. The emission luminance distributions are different for the respective slight sources 201, 202, 203, 204.

As is understood from FIG. 8, the emission luminance distribution extends to the neighboring light source positions. Therefore, since it is necessary to perform signal-level conversion based on luminance when the backlight 106 emits light according to the luminance signal 11, the luminance distribution calculating unit 607 calculates, for each of light sources 201, 202, 203, and 204, backlight luminance distribution by adding emission luminance distributions of the corresponding light sources of the multi-color light sources 110 that emit light according to a luminance signal 11.

Figure 9:
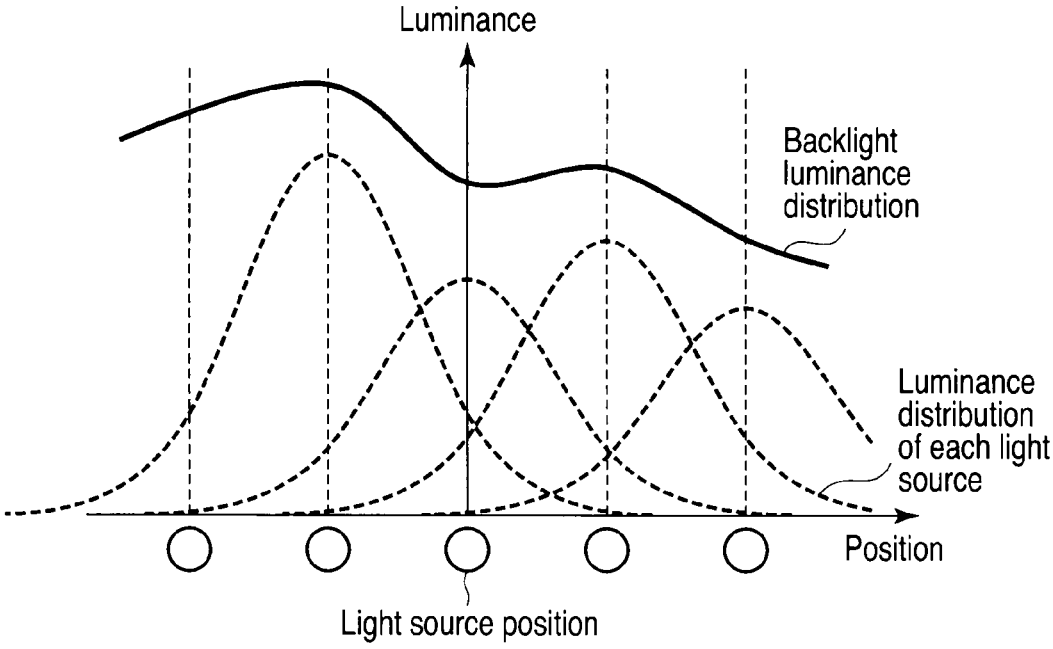
FIG. 9 is a graph schematically showing luminance distribution when light sources in the backlight shown in FIG. 6 emit light.

FIG. 9 schematically shows luminance distribution when a plurality of light sources in the backlight 106 emit light. For simplifying the explanation, FIG. 9 shows one-dimensional luminance distribution. In FIG. 9, all of the light sources in positions indicated by circles below the transverse axis emit light and the respective light sources have individual emission luminance distributions indicated by broken lines. The luminance distribution by the plurality of light sources which is indicated by the solid line is calculated by adding the emission luminance distributions.

The emission luminance distribution shown in FIG. 8 can be obtained by actually causing the light source to independently emit light and measuring the luminance. In this embodiment, an LUT (shown in FIG. 10) in which the relationship between the distance from the light source and the luminance obtained based on the measurement is listed is previously stored in a recording medium such as a ROM. In another example, emission luminance distribution may be derived based on the measurement as an approximate function of the distance from the light source and the approximate function may be stored in the luminance distribution calculating unit 607.

Figure 10:
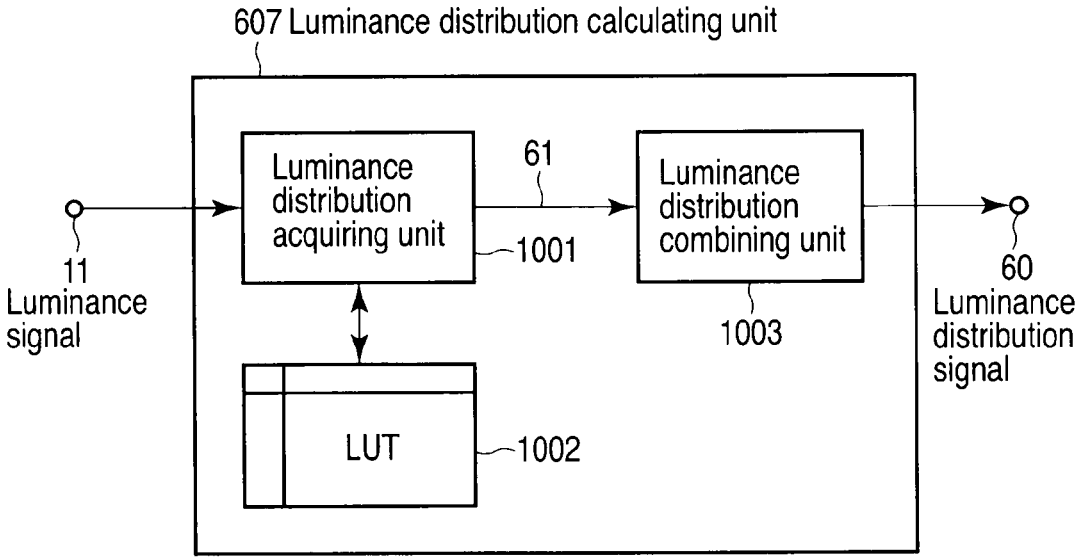
FIG. 10 is a block diagram schematically showing a luminance distribution calculating unit shown in FIG. 6.

FIG. 10 is a block diagram showing a luminance distribution calculating unit 607 in more detail. In the luminance distribution calculating unit 607, a luminance signal 11 is input to a luminance distribution acquiring unit 1001. The luminance distribution acquiring unit 1001 acquires emission luminance distributions of the red light source 201, green light source 202, blue light source 203 and cyan light source 204 from an LUT 1002. Then, the luminance distribution acquiring unit 1001 multiplies, for each of the light sources 201, 202, 203, and 204 and for each of the divisional areas, the calculated light source luminance by the emission luminance distribution to derive luminance distribution as indicated by the broken line in FIG. 9. The derived luminance distributions 61 are transmitted to a luminance distribution combining unit 1003.

The luminance distribution combining unit 1003 adds together the luminance distributions 61 for the respective divisional areas to calculate backlight luminance distribution. The above process is performed for each of the red light source 201, green light source 202, blue light source 203 and cyan light source 204 to calculate backlight luminance distribution and generate a luminance distribution signal 60. The luminance distribution signal 60 is input to the signal level converting unit 102.

The signal level converting unit 102 converts signal levels of the three primary colors of the input image signal 10 based on the luminance distribution signal 60 to generate a converted image signal 12.

In the present embodiment, light source luminances of the multi-color light sources 110 calculated by the luminance-setting unit 101 are different in respective positions (x, y) of the input image signal 10. That is, light source luminances of the multi-color light sources 110 are expressed by $R_{BL}$, $G_{BL}$, $B_{BL}$, $C_{BL}$ in the first embodiment, but are expressed by $R_{BL}(x, y)$, $G_{BL}(x, y)$, $B_{BL}(x, y)$, $C_{BL}(x, y)$ with the position (x, y) used as a variable.

First, like the luminance-setting unit 101, the signal level converting unit 102 calculates tristimulus values $X_t(x, y)$, $Y_t(x, y)$, $Z_t(x, y)$ after color gamut conversion based on signal levels $L_R(x, y)$, $L_G(x, y)$, $L_B(x, y)$ of the pixel position (x, y) of the input image signal 10. Then, the signal level converting unit 102 refers an LUT (not shown) with the tristimulus values $X_t(x, y)$, $Y_t(x, y)$, $Z_t(x, y)$ obtained after color gamut conversion and luminance values $R_{BL}(x, y)$, $G_{BL}(x, y)$, $B_{BL}(x, y)$, $C_{BL}(x, y)$ to derive converted signal levels. As described before, in the LUT, the relationship between the luminance values, tristimulus values obtained after color gamut conversion and converted signal levels is listed. The signal level converting unit 102 performs the above process for the signal levels of all of the pixels of the input image signal 10 to generate a converted image signal 12. The converted image signal 12 is transmitted to the control unit 103.

The control unit 103 generates a drive signal 13 including the converted image signal 12 and a synchronizing signal that specifies timing at which the converted image signal 12 is applied to the liquid crystal panel 105. Further, the control unit 103 generates a control signal 14 to cause the multi-color light sources 110 of the backlight 106 to actually emit light based on the luminance signal 11 and generates a timing signal 15 that specifies timing at which the multi-color light sources 110 emit light. More specifically, the control unit 103 causes the light sources 201, 202, 203, 204 to emit light with luminance according to the luminance signal 11 and have periods in which the light sources 201, 202, 203 and 204 simultaneously emit light. The drive signal 13 is supplied to the liquid crystal panel 105 and the control signal 14 and timing signal 15 are supplied to the backlight 106.

In the present embodiment, the control signal 14 is generated for each divisional area on the backlight 106. The timing signal 15 is a signal that specifies emission start timing to cause the red light source 201, green light source 202, blue light source 203 and extended light source 204 to have periods in which light is simultaneously emitted. That is, the control unit 103 of the present embodiment is similar to the first embodiment except that the relationship between the timing signal and the control signals of the light sources 201, 202, 203 and 204, as shown in FIG. 5(*a*) to (*e*), is set for each divisional area.

The drive signal 13, control signal 14 and timing signal 15, which are generated in the above process, are input to the image display unit 104. The drive signal 13 includes synchronizing signals (i.e., horizontal and vertical synchronizing signals) to drive the liquid crystal panel 105.

As described above, the image display unit 104 includes the liquid crystal panel 105 corresponding to a light modulating unit and the backlight 106 arranged on the back surface of the liquid crystal panel 105 and including the multi-color light sources 110. In the image display unit 104, the liquid crystal panel is driven by the drive signal 13 from the control unit 103 and the multi-color light sources 110 of the backlight 106 emit light with luminance according to the control signal 14 from the control unit 103 for each divisional area of the backlight 106. Thus, an image depending on the input image signal 10 is displayed on the image display unit 104. In the present embodiment, LED light sources are used as the light sources of the backlight 106.

As described above, the display apparatus according to the second embodiment can display an image with higher contrast and in a wider reproducible color gamut in comparison with the first embodiment by tentatively dividing the backlight 106 into a plurality of divisional areas and controlling the backlight 106 for each divisional area.

According to a display apparatus of at least one embodiment describe above, an extended light source is provided with multi-color light source in addition to a basic light source which can emit light in white and, therefore, a wide reproducible color gamut and high contrast can be achieved.

In the above embodiment, an example in which the image display unit 104 is a transmissive liquid crystal display unit having a combination of the transmissive liquid crystal panel 105 and backlight 106 is described, but embodiments are not limited to this case. The embodiments described herein can be applied to various types of image display unit other than the transmissive liquid crystal display unit. For example, it can be applied to a projection type image display unit using in combination of a liquid crystal panel and light source such as a halogen light source. Further, the image display unit 104 may be a projection type image display unit utilizing a halogen light source as a light source unit and a digital micro-mirror device that displays an image by controlling reflection of light from the halogen light source as a light modulating element.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display apparatus comprising:

a light modulating unit configured to modulate light in accordance with a drive signal, and display an image in a display area;

a light source unit including a basic light source and an extended light source illuminating each of divisional areas into which the display area is tentatively divided, the basic light source including a red light source having a first emission peak wavelength corresponding to red, a green light source having a second emission peak wavelength corresponding to green, and a blue light source having a third emission peak wavelength corresponding to blue, the extended light source having a fourth emission peak wavelength being different from the first emission peak wavelength, the second emission peak wavelength, and the third emission peak wavelength, and being within a range between the third emission peak wavelength and the first emission peak wavelength;

a luminance setting unit configured to calculate, for each of the divisional areas, luminance values of the red light source, the green light source, the blue light source, and the extended light source based on a signal level of an input image signal;

a luminance distribution calculating unit configured to calculate luminance distributions of colors corresponding to the first emission peak wavelength, the second emission peak wavelength, the third emission peak wavelength, and the fourth emission peak wavelength when the red light source, the green light source, the blue light source and the extended light source emit light in accordance with a luminance signal, sent from the luminance setting unit, and generate luminance distribution signals of the red light source, the green light source, the blue light source, and the extended light source;

a signal level converting unit configured to convert, for each pixel of the input image signal level levels of sub-pixels of the pixel based on a combination of the luminance distribution signals and a combination of the sub-pixels, the sub-pixels indicating different color components; and a control unit configured to generate the drive signal based on a converted image signal and generate a control signal controlling the basic light source and the extended light source based on the luminance signal so as to provide a period in which the basic light source and the extended light source simultaneously emit light.

2. The apparatus according to claim 1, wherein the luminance calculating unit comprises a color gamut converting unit configured to convert the signal level from a color gamut of the input image signal to a predetermined color gamut to generate a color gamut converted image signal, and a luminance signal generating unit configured to calculate luminance values of the red light source, the green light source, the blue light source, and the extended light source based on the color gamut converted image signal to generate a luminance signal.

3. The apparatus according to claim 2, wherein the color gamut converting unit converts the signal level from a color gamut of the input image signal to a maximum color gamut obtained by controlling the red light source, the green light source, the blue light source, and the extended light source to generate the color gamut converted image signal.

4. The apparatus according to claim 1, wherein the signal level converting unit includes a look-up table in which a relationship of a combination of sub-pixels of each pixel of the converted image signal and a combination of sub-pixels of each pixel of the input image signal is listed for each combination of the luminance distribution signals of the red light source, the green light source, the blue light source, and the extended light source, and generates the converted image signal by referring to the look-up table with the signal levels of the sub-pixels of the pixel of the input image signal.

* * * * *